US008387571B2

(12) United States Patent
Ulrey et al.

(10) Patent No.: US 8,387,571 B2
(45) Date of Patent: Mar. 5, 2013

(54) OIL DELIVERY SYSTEM

(75) Inventors: Joseph Norman Ulrey, Dearborn, MI (US); Cliff Maki, New Hudson, MI (US); Rick L. Williams, Canton, MI (US); Eva Barber, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/289,877

(22) Filed: Nov. 4, 2011

(65) Prior Publication Data

US 2012/0138010 A1 Jun. 7, 2012

(51) Int. Cl.
*F01P 1/04* (2006.01)

(52) U.S. Cl. ..... 123/41.35; 123/196 R; 123/196 AB

(58) Field of Classification Search .... 123/41.34–41.37, 123/41.33, 196 AB, 196 R
See application file for complete search history.

(56) References Cited

U.S. PATENT DOCUMENTS

| | | | | |
|---|---|---|---|---|
| 3,065,743 | A * | 11/1962 | Brehm et al. | 123/41.35 |
| 3,485,324 | A * | 12/1969 | Novak | 123/196 R |
| 3,741,342 | A | 6/1973 | Maddalozzo | |
| 4,364,339 | A | 12/1982 | Fricker et al. | |
| 4,834,028 | A | 5/1989 | Oetting | |
| 4,926,800 | A | 5/1990 | Valev | |
| 6,032,619 | A | 3/2000 | Zhu et al. | |
| 6,672,261 | B1 | 1/2004 | Svensson | |
| 7,819,093 | B2 | 10/2010 | Yamashita et al. | |
| 7,823,545 | B2 | 11/2010 | Arvan et al. | |
| 2009/0229561 | A1 | 9/2009 | Yamashita et al. | |

FOREIGN PATENT DOCUMENTS

| | | | |
|---|---|---|---|
| JP | 01077719 | A * | 3/1989 |
| JP | 2003020945 | A * | 1/2003 |
| RU | 2174612 | C1 * | 10/2001 |
| WO | 2010/032118 | A1 | 3/2010 |

* cited by examiner

*Primary Examiner* — Noah Kamen
(74) *Attorney, Agent, or Firm* — Julia Voutyras; Alleman Hall McCoy Russell & Tuttle LLP

(57) ABSTRACT

Systems and methods for delivering oil to an engine are provided herein. According to one embodiment, the oil delivery system includes an oil supply, a feeder passage fluidically coupled to the oil supply and a cylinder head, the feeder passage coupled to a pump and a filter positioned downstream from the pump. The oil delivery system further includes a squirter passage in fluidic communication with a plurality of piston squirters and the feeder passage at a position between the pump and the filter. In this way, less-filtered oil is selectively routed through a cooling circuit to reduce engine warm-up time.

17 Claims, 4 Drawing Sheets

OIL DELIVERY SYSTEM

BACKGROUND AND SUMMARY

Vehicles may use an oil delivery system to lubricate and/or cool various components of an internal combustion engine.

For example, U.S. Pat. No. 7,823,545 describes a piston squirter system that squirts oil on an underside of each piston. The system includes a gallery that connects a pump to the piston squirters. Further, the system is arranged such that it excludes control valves, and oil is delivered to the piston squirters in response to oil pressure.

The inventors herein have recognized various issues with the above system. In particular, by excluding control valves, cooled oil is circulated through the system at any engine operating condition. Further, by not controlling oil flow to the piston squirters, engine warm up is delayed, which also increases emissions.

As such, one example approach to address the above issues is to separate a squirter passage from a feeder passage such that a cooler is positioned within the squirter passage and not included within the feeder passage. In this way, it is possible to lubricate various engine components, while reducing engine warm-up time. Specifically, the squirter passage includes a valve upstream from the cooler that selectively communicates the cooler with the feeder passage at a position upstream from a filter provided within the feeder passage. This configuration enables less-filtered oil to be routed through the squirter passage and provided to the cooler after engine warm up. Further, by taking advantage of only cooling less-filtered oil in one embodiment, a peak flow through the filter can be reduced. In an alternative, more-filtered and less-filtered oil may be selectively cooled, for example.

Note that various sensors may provide input to a controller for actuating the valve to selectively communicate the cooling circuit with the oil feeder passage. Further, various return passages may be included in the oil delivery system. Further still, the cooling circuit may include a filter, if desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to an oil delivery system that includes a filtering circuit and a cooling circuit, which are arranged in such a way that cooled oil is selectively provided to a plurality of piston squirters. This arrangement allows for rapid engine warm up as oil flow may be circulated through a cooler of the cooling circuit after engine warm up. Further, by separating the filtering circuit from the cooling circuit, various engine components can be lubricated during various operating conditions including engine warm up. Various valves may be included in the disclosed system to selectively communicate the cooling circuit with a feeder passage. For example, during engine warm up, unfiltered oil may be directed to the oil supply to bypass the cooler. Further, when the engine operating temperature exceeds a predetermined threshold, unfiltered oil may be permitted to flow through a cooler and to the downstream plurality of piston squirters. Additionally, the oil delivery system may be communicatively coupled to a controller configured to receive temperature information from various sensors to evaluate the operational state of the engine, and thus the state of the cooling circuit.

Figure 1:
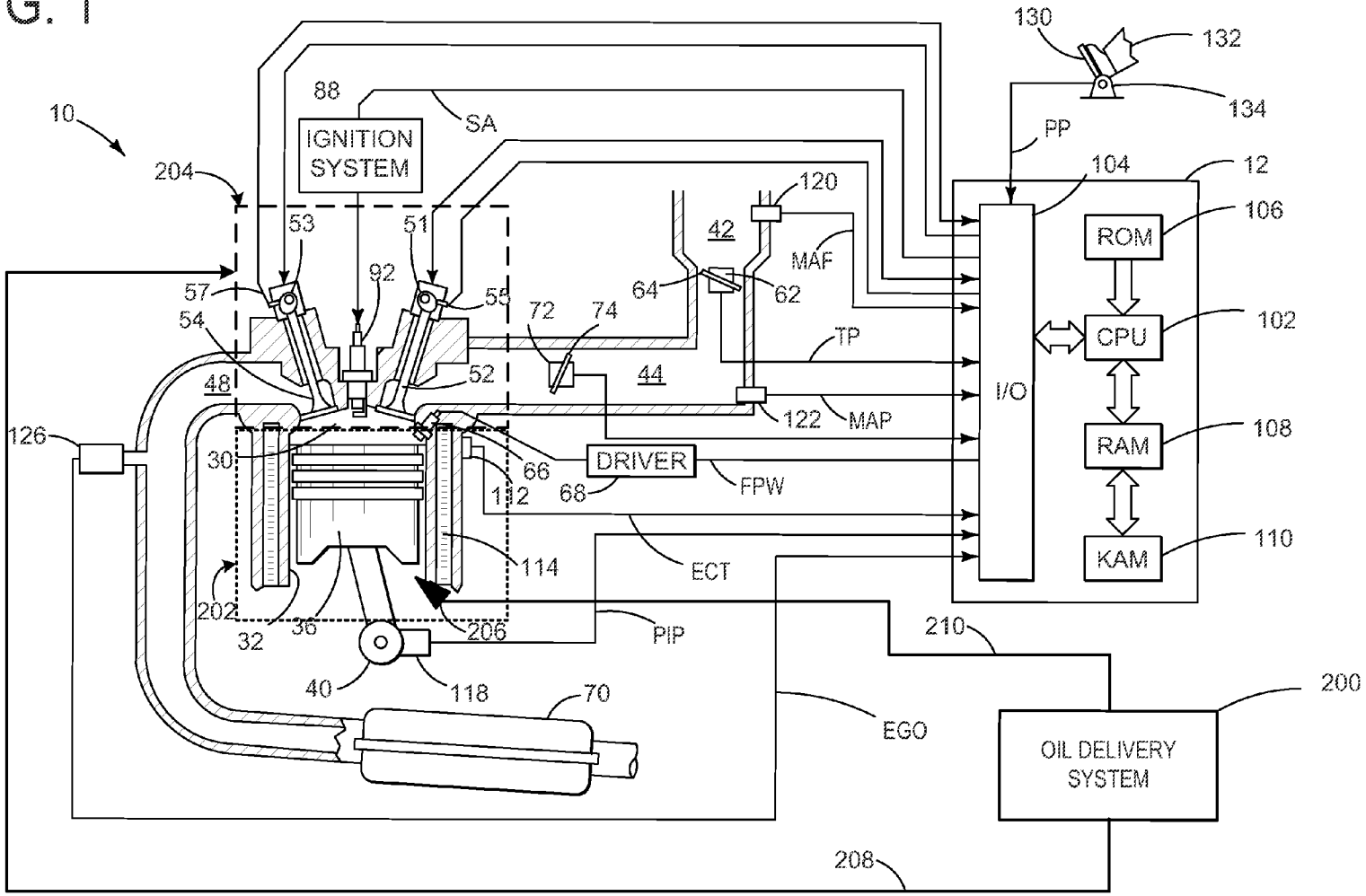
FIG. 1 shows a schematic diagram of an example engine.

FIG. 1 is a schematic diagram showing one cylinder of multi-cylinder internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Engine 10 shows an example combustion cylinder 30 including an engine block region 202 and a cylinder head region 204. Engine block region 202 may include combustion cylinder walls 32 as described further below. Cylinder head region 204 may include one or more values for selectively communicating with an intake and an exhaust system, for example. Further, cylinder head region 204 may include a fuel injector, and a spark plug, for example. It will be appreciated that engine block region 202 and cylinder head region 204 may include additional and/or alternative components than those illustrated in FIG. 1 without departing from the scope of this disclosure.

Combustion cylinder 30 of engine 10 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion cylinder 30 may receive intake air from intake manifold 44 via intake passage 42 and may exhaust combustion gases via exhaust passage 48. Intake manifold 44 and exhaust passage 48 can selectively communicate with combustion cylinder 30 via respective intake valve 52 and exhaust valve 54. In some embodiments, combustion cylinder 30 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal FPW received from controller 12 via electronic driver 68. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. In some embodiments, combustion cylinder 30 may alternatively or additionally include a fuel injector arranged in intake passage 42 in a configuration that provides what is known as port injection of fuel into the intake port upstream of combustion cylinder 30.

Intake passage 42 may include a charge motion control valve (CMCV) 74 and a CMCV plate 72 and may also include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 42 may include a mass air flow sensor 120 and a manifold air pressure sensor 122 for providing respective signals MAF and MAP to controller 12.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air-fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Oil delivery system 200 may deliver oil to engine block region 202 and cylinder head region 204. For example, unfiltered oil may be routed to the engine block region to cool an underside of piston 36 via a piston squirter 206. Piston squirter 206 may spray unfiltered cooled oil to reduce a temperature of piston 36 at some operating conditions. For example, piston squirter 206 may spray the underside of piston 36 after engine warm up. Further, filtered oil may be routed to the cylinder head region to lubricate various components housed within cylinder head region 204. An example oil delivery system configuration is described further below with respect to FIG. 2.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. The controller 12 may receive various signals and information from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Further, controller 12 may receive input from temperature sensor 112 and/or from another temperature sensor to determine a temperature of engine 10. Such information may be used to determine an oil delivery routing pathway, as described in more detail below with respect to FIGS. 3 and 4. Storage medium read-only memory 106 can be programmed with computer readable data representing instructions executable by processor 102 for performing the methods described below as well as variations thereof. In some embodiments, the engine cooling sleeve 114 may be coupled to oil delivery system 200 and/or a cabin heating system.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

As described above, FIG. 1 shows only one cylinder of a multi-cylinder engine, and each cylinder may similarly include its own set of intake/exhaust valves, fuel injector, ignition system, etc.

Figure 2:
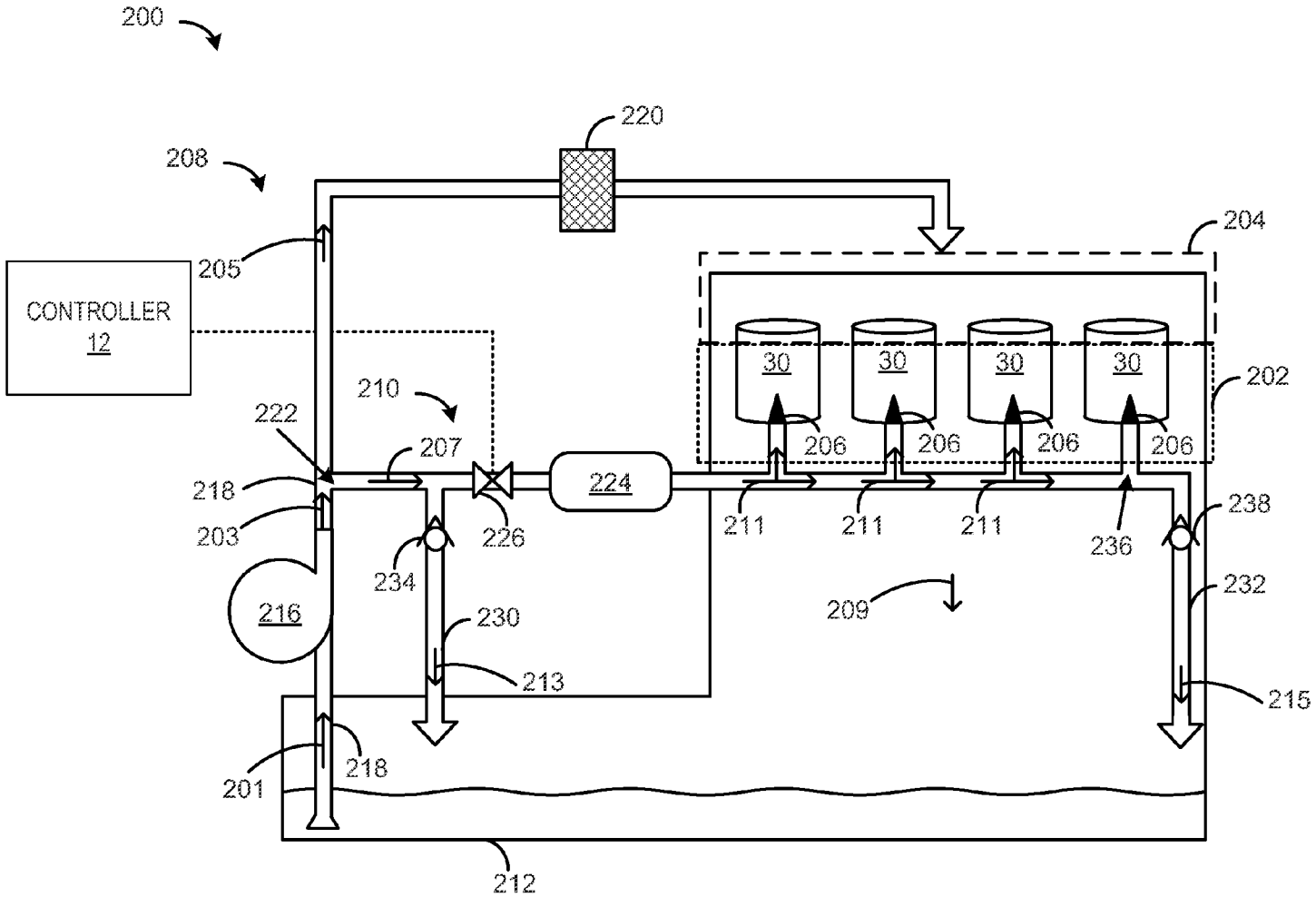
FIG. 2 shows a schematic diagram of an example oil delivery system that may be included in the example engine of FIG. 1, according to an embodiment of the present disclosure.

FIG. 2 shows a schematic diagram of an example oil delivery system 200 that may be included in engine 10 of FIG. 1. As shown, oil delivery system 200 includes a first circuit 208 that delivers filtered oil to cylinder head region 204, and a second circuit 210 that selectively delivers unfiltered oil to engine block region 202. As shown, oil delivery system 200 further includes an oil supply 212, a suction passage 214, and a pump 216.

Briefly, pump 216 may drive oil flow by suctioning oil from oil supply 212 through suction passage 214 in a direction generally indicated by arrow 201. As such, oil supply 212, suction passage 214, and pump 216 may be in fluidic communication. Various pumps may be utilized without departing from the scope of this disclosure. For example, pump 216 may be a gear pump, a trochoid pump, a vane pump, a plunger pump, or another suitable pump. Pump 216 may be driven in various ways. For example, in some embodiments pump 216 may be driven by a drive system, whereas in some embodiments pump 216 may be an electric pump.

Downstream from pump 216, oil may flow through feeder passage 218 in a direction generally indicated by arrow 203. Further, downstream from pump 216, oil flow may be routed through first circuit 208 and/or second circuit 210. Arrow 205 generally shows an oil flow direction through first circuit 208, which is downstream from pump 216. Further, arrow 207 generally shows an oil flow direction through second circuit 210, which is also downstream from pump 216. As shown, first circuit 208 and second circuit 210 may be fluidically coupled to feeder passage 218, and therefore also in fluidic communication with pump 216.

As used herein, a circuit generally refers to a cyclic loop in that oil is suctioned from the supply, delivered to various features of engine 10, and returned to the oil supply for redistribution. It will be appreciated that oil may return to the oil supply via any suitable route. For example, one or more oil return passages may channel oil directly to the oil supply. As another example, oil may drip from various components, wherein the oil drips are collected by the oil supply as a result of gravitational forces.

As shown, first circuit 208 routes pumped oil through a filter 220. Therefore, first circuit 208 may be referred to herein as a filtering circuit. As such, oil is filtered prior to being delivered to various components of cylinder head region 204. Therefore, filter 220 is downstream from pump 216, as shown. Further, filter 220 is downstream from an inlet 222 of second circuit 210. Filter 220 may be any suitable filter for removing oil particulates. For example, filter 220 may be a cartridge that removes particulates that are greater than a pore size of the filter. As another example, filter 220 may be magnetic and thus, may sequester ferromagnetic particles. As yet another example, filter 220 may trap particulates via sedimentation, centrifugal forces, or another method for removing particulates from the oil flow.

It will be appreciated that first circuit 208 may deliver filtered oil to other regions of engine 10. For example, filtered oil may be delivered to various actuators such as hydraulic tappets. As another example, filtered oil may be delivered to a tensioner arm for an engine drive system.

Further, it will be appreciated that filtered oil delivered to the various engine components may be returned to oil supply 212 in any suitable way. The illustrated embodiment shows that oil from first circuit 208 may be returned to oil supply 212 via gravity (in a direction generally indicated by arrow 209); however, other configurations are possible without departing from the scope of this disclosure. For example, first circuit 208 may include an oil return passage to channel oil flow back to oil supply 212.

As shown, second circuit 210 selectively routes pumped oil through a cooler 224 via actuation of a valve 226. Therefore, second circuit 210 may be referred to herein as a cooling circuit. Further, second circuit 210 may not include a filter, as shown. Therefore, unfiltered oil may be delivered through cooler 224 to reduce a temperature of the unfiltered oil. However, in some embodiments, the second circuit may include a filter, if desired. For example, when included, a second circuit filter may have a different porosity than filter 220. As one example, such a second circuit filter may have a larger porosity than filter 220. Therefore, oil routed through the second circuit may be less-filtered than oil routed through the first circuit. As another example, filters may be positioned upstream from inlet 222. For example, a filter may be integrated with pump 216, and/or a filter may be positioned along the suction passage upstream from the pump. In this way, oil may be filtered prior to be routed through the first circuit or the second circuit. Even still, oil flowing through first circuit may be finer filtered than oil flowing through second circuit.

As shown, inlet 222 of second circuit 210 is fluidically coupled to feeder passage 218 at a position between pump 216 and filter 220. Further, valve 226 is positioned between inlet 222 and cooler 224 as shown. Said in another way, valve 226 is positioned downstream from inlet 222 and upstream from cooler 224. Valve 226 may be actuated via controller 12 in response to various signals received by controller 12. For example, various sensors may provide input that may be used to ascertain an operational state of engine 10, and controller 12 may control an opening or closing of valve 226 based on the operational state. In this way, cooler 224 may selectively communicate with feeder passage 218 based on the operational state of the engine. Selectively communicating cooler 224 with feeder passage 218 is described in more detail below with reference to FIGS. 3 and 4.

Further, second circuit 210 may include a squirter passage 228, a first return passage 230, and a second return passage 232. Squirter passage 228 may be in fluidic communication with cooler 224. Further, squirter passage 228 may include a plurality of branches, wherein each branch is fluidically coupled to a piston squirter 206. As described above, each piston squirter may spray oil to an underside of a respective piston to lubricate and cool the piston. The plurality of piston squirters 206 may be any suitable device for injecting an oil spray to the underside of the piston. It will be appreciated that the plurality of piston squirters may be arranged in any suitable way to aim an oil spray at least at a portion of the piston. In some embodiments, when valve 226 is open, oil may be permitted to flow through cooler 224 and may be directed to each of the plurality of piston squirters 206 via squirter passage 228 in a direction generally indicated by arrows 211.

First return passage 230 may be in fluidic communication with feeder passage 218. As shown, first return passage 230 may be positioned within second circuit 210 at a location downstream from inlet 222 and upstream from valve 226. Further, first return passage 230 may include a one-way valve 234. For example, one-way valve 234 may be a check valve; however various other one-way valves are possible. In some embodiments, when valve 234 is closed, oil may be enabled to flow through return passage 230 and return to oil supply 212 in a direction generally indicated by arrow 213. Further, in some embodiments, when valve 234 is open, some oil may be enabled to flow through return passage 230 to channel excessive oil flow back to oil supply 212. In this way, oil pressure fluctuations within squirter passage 228 may be reduced.

Second return passage 232 may be in fluidic communication with squirter passage 228. As shown, second return passage 232 may be positioned downstream from a final squirter passage branch 236. Further, second return passage 232 may include a one-way valve 238. For example, one-way valve 238 may be a check valve; however various other valves are possible. In some embodiments, an oil pressure within squirter passage 228 may overcome one-way valve 238 such that oil flow is enabled through one-way valve 238 to return oil to oil supply 212 in an oil flow direction generally indicated by arrow 215. In such a scenario, an oil pressure at each piston squirter can be reduced, and thus piston squirter spray variation can be reduced. It will be appreciated that second return passage 232 may be fluidically coupled to squirter passage 228 at any suitable location, and is not limited to the position illustrated in FIG. 2.

It will be appreciated that second circuit 210 may be referred to as a cooling circuit due to the particular location of the cooler. Further, it is to be understood that since second circuit returns cooled oil to the oil supply, that first circuit 208 may also deliver cooled oil to lubricate, and cool, various components of engine 10. Said in another way, first circuit 208 is dependent upon second circuit 210 in order to circulate cooled oil. In this way, second circuit 210 can potentially reduce a temperature of the oil supply, and the first circuit may advantageously circulate cooled oil without having a cooler positioned along the first circuit. Thus, a larger cooler may be used within second circuit 210 since the cooler selectively communicates with feeder passage 218. By utilizing a larger cooler, oil may be cooled more rapidly without overcooling all the circulating oil. In this way, oil temperature can be regulated to match various engine operating conditions. For example, fluidic communication between cooler 224 and feeder passage 218 may be enabled after engine warm-up. As another example, fluidic communication between cooler 224 and feeder passage 218 may be inhibited via a closed valve during cold start and/or up until the engine exceeds a predetermined threshold temperature. Selectively communicating cooler 224 with feeder passage 218 is described in more detail below with reference to FIGS. 3 and 4.

It will be appreciated that oil delivery system 200 is provided by way of example, and thus, is not meant to be limiting. Rather, oil delivery system 200 is provided to introduce a general concept, as various configurations are possible without departing from the scope of this disclosure. Thus, it will be appreciated that FIG. 2 may include additional and/or alternative components than those illustrated. For example, in some embodiments, the first and second circuits may not share a common suction passage. As such, each circuit may have a separate suction passage and a separate pump. Further, some components may be omitted from the example oil delivery system without departing from the scope of this disclosure. For example, in some embodiments one or more valves may be excluded from the cooling circuit. For example, one or more return passages may be configured without a valve. Further still, another filter may be positioned along second circuit and/or upstream from second circuit such that oil that is less-filtered than oil routed through the first circuit is routed through the second circuit.

Figure 3:
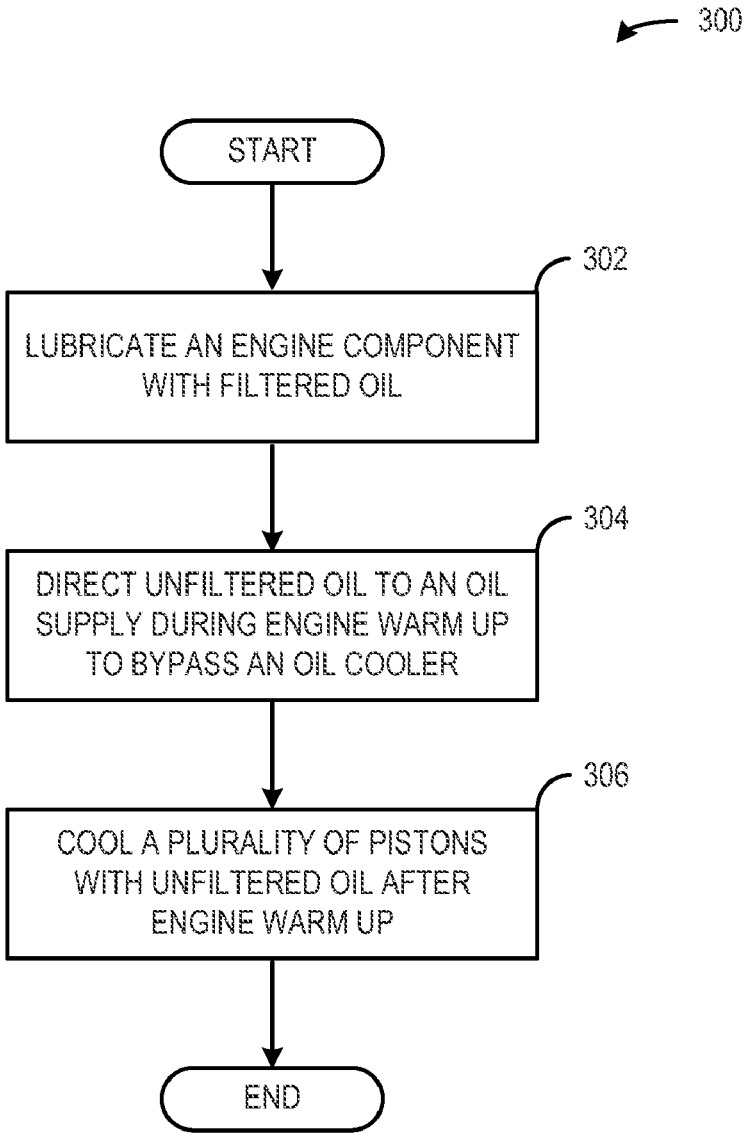
FIG. 3 shows a flowchart illustrating an example method for operating the example oil delivery system of FIG. 2, according to an embodiment of the present disclosure.

FIG. 3 shows a flowchart illustrating an example method 300 for operating the oil delivery system 200. At 302, method 300 includes lubricating an engine with filtered oil. For example, filtered oil may be delivered to a cylinder head to lubricate various drive shafts, bearings and other components housed within the cylinder head. Further, oil may be pumped through a feeder passage and delivered to a downstream filter, such as filter 220 of FIG. 2.

At 304, method 300 includes directing unfiltered oil (or less-filtered oil) to an oil supply during engine warm-up to bypass an oil cooler. For example, unfiltered oil may be inhibited from passing through a cooler, and instead, such unfiltered oil may be returned to an oil supply. In this way, the cooler may be inhibited from affecting the oil temperature, and as such, engine warm up time may be reduced.

At 306, method 300 includes cooling a plurality of pistons with unfiltered oil (or less-filtered oil) after engine warm-up. For example, unfiltered oil may be permitted to flow through a cooler, and further, to flow to a plurality of piston squirters downstream from the cooler. By permitting unfiltered cooled oil to flow to the plurality of piston squirters after engine warm-up, engine block temperatures may be maintained without delaying engine warm-up.

Further, by directly cooling only a portion of the oil delivery circuit under certain operating conditions, pressure losses due to the cooled oil may be reduced. Further still, by providing filtered oil to the cylinder head without cooling the filtered oil, engine knock may be reduced. Furthermore, peak flow through the filter (e.g., filter 220) may be reduced by routing oil to be cooled through a separate unfiltered oil delivery circuit. Additionally, by actively controlling oil routing through the various oil delivery circuits, a larger cooler may be utilized without overcooling the entire oil delivery circuit. An example of controlling oil delivery using the oil delivery system of FIG. 2 is described below with respect to FIG. 4.

It will be appreciated that method 300 is provided by way of example, and thus, is not meant to be limiting. As such, it is to be understood that method 300 may included additional and/or alternative steps than those illustrated in FIG. 3 without departing from the scope of this disclosure. Further, it is to be understood that method 300 may be performed in any suitable order and/or one or more steps may be omitted without departing from the scope of this disclosure.

Figure 4:
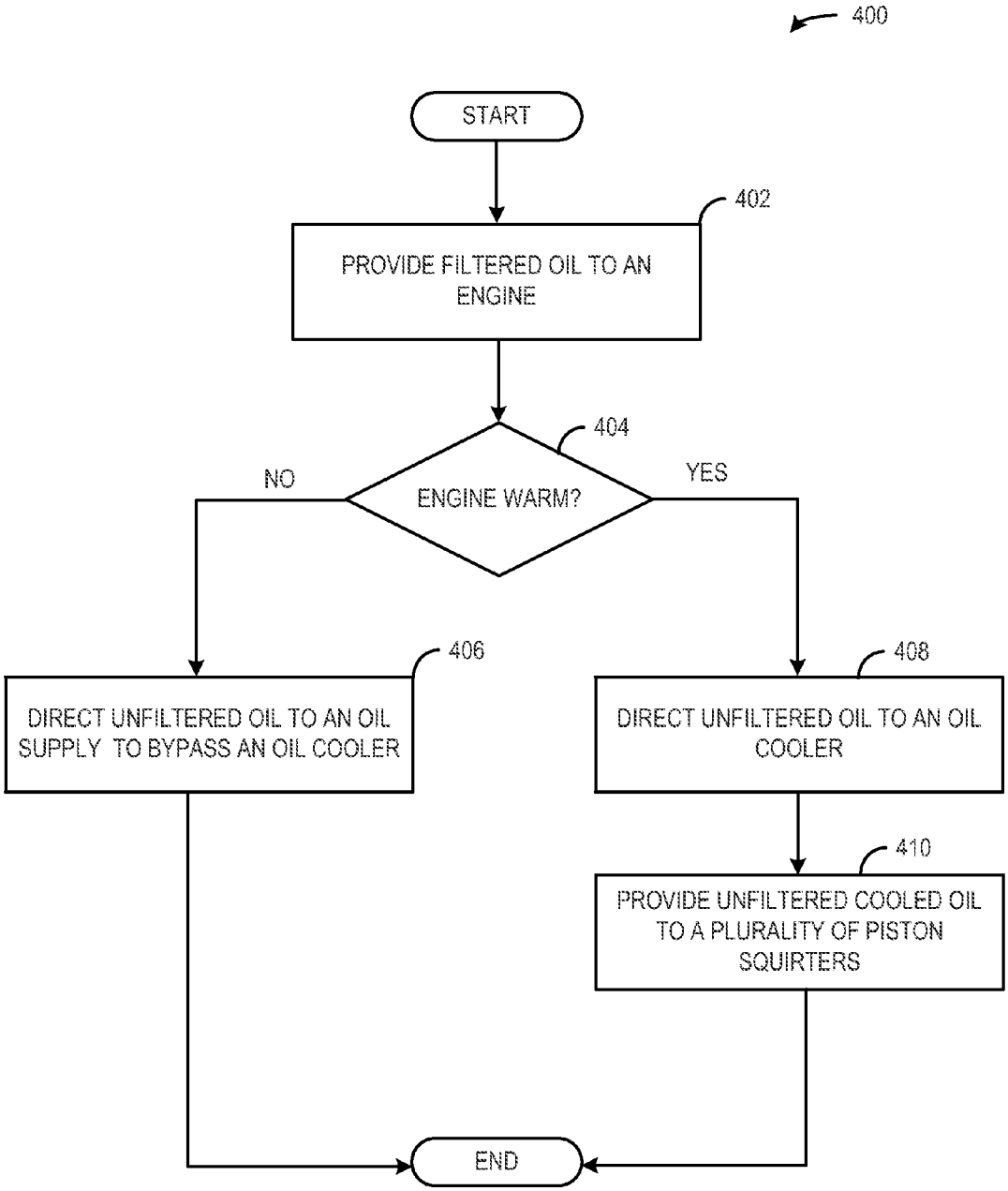
FIG. 4 shows a flowchart illustrating an example method for controlling the example oil delivery system of FIG. 2, according to an embodiment of the present disclosure.

FIG. 4 shows a flowchart illustrating an example method 400 for controlling the oil delivery system 200. At 402, method 400 includes providing filtered oil to an engine. For example, filtered oil may be provided to a cylinder head for lubricating one or more camshafts and various other components that may be included within the cylinder head.

At 404, method 400 includes determining if the engine is warm. For example, various sensors may be used to determine if the engine is warm. In some embodiments, the engine may be determined to be sufficiently warm when a catalyst reaches light-off. A temperature sensor reading above a threshold value may indicate if a temperature of the catalyst reaches a threshold indicative of light-off operating conditions, which may be additionally used to actuate one or more valves of the oil delivery system, for example. It will be appreciated that various sensors, alone or in combination, may be used to determine if the engine is sufficiently warm. If the answer to 404 is NO, method 400 continues to 406. If the answer to 404 is YES, method 400 continues to 408.

At 406, method 400 includes directing unfiltered oil to an oil supply to bypass an oil cooler. For example, valve 226 of FIG. 2 may be closed and an oil pressure may overcome one-way valve 234. Thus, unfiltered oil may return to the oil supply via a return passage such as return passage 230. It will be appreciated that such unfiltered oil is unfiltered because the oil is not routed through filter 220. As described above, in some embodiments, oil flowing through second circuit may be less-filtered than oil passing through filter 220, thus oil bypassing the oil cooler via return passage 230 may be unfiltered or less-filtered when compared to oil passing through first circuit 208, for example.

In this way, oil is not routed through a cooler during engine warm-up, and a plurality of piston squirters are not provided with cooled unfiltered oil. As such, engine warm-up may be reached more rapidly. The inventors herein have recognized that piston and oil cooling may be controlled by a common control mechanism. By separating the oil delivery system into a filtered circuit and a cooling circuit, oil may be provided to various components for lubrication even when the engine operating condition does not prompt a controller to enable oil flow through the cooling circuit. In this way, engine warm-up time may be reduced.

At 408, method 400 includes directing unfiltered oil to an oil cooler (e.g., cooler 224 of FIG. 2). For example, valve 226 may be opened and oil may be permitted to flow through the cooler to reduce a temperature of the oil. As such, a temperature of the oil downstream from cooler 224 may be colder than a temperature of the oil upstream from cooler 224. In this way, such oil directed through the cooling circuit is not filtered by filter 220.

At 410, method 400 includes providing unfiltered cooled oil to a plurality of piston squirters. For example, unfiltered cooled oil may flow to the plurality of piston squirters positioned downstream from the cooler, wherein the unfiltered cooled oil is not filtered by filter 220. Further, excess oil may be routed through an oil return passage, such as return passage 232 of FIG. 2 to reduce oil pressure at the plurality of piston squirters. Thus, unfiltered cooled oil may be provided to the plurality of piston squirters after engine warm up even at high engine load and/or at high engine speed.

In this way, unfiltered cooled oil may be sprayed at an underside of each of a plurality of pistons, and further, spray variation may be reduced due to return passage 232 regulating a pressure drop across the plurality of piston squirters downstream from the cooler. As such, cylinder block temperatures may be regulated. Further, since unfiltered cooled oil expelled from each of the plurality of piston squirters returns to the oil supply, a temperature of the oil supply may be adjusted by the cooled oil. As such, a temperature of the oil pumped through filter 220 and delivered to the cylinder head may also be adjusted by the cooled oil, as described above.

It will be appreciated that method 400 is provided by way of example, and thus, is not meant to be limiting. As such, it is to be understood that method 400 may included additional and/or alternative steps than those illustrated in FIG. 4 without departing from the scope of this disclosure. Further, it is to be understood that method 400 may be performed in any suitable order and/or one or more steps may be omitted without departing from the scope of this disclosure.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine oil system, comprising:

an oil supply;

a feeder passage fluidically coupled to the oil supply and a cylinder head, the feeder passage coupled to a pump and a filter positioned downstream from the pump;

a squirter passage in fluidic communication with a plurality of piston squirters and the feeder passage at a position between the pump and the filter, a cooler positioned along the squirter passage upstream from the plurality of piston squirters, a valve positioned along the squirter passage upstream from the cooler, and a return passage fluidically coupled to the squirter passage upstream from the valve.

2. The system of claim 1, further comprising a controller communicatively coupled to the valve to direct an oil flow through the return passage or through the cooler.

3. The system of claim 2, wherein the controller directs the oil flow through the return passage during engine warm up, and the controller directs the oil flow through the cooler after engine warm up to cool a plurality of pistons.

4. The system of claim 1, wherein the valve is a check valve.

5. The system of claim 1, wherein the return passage is fluidically coupled to the squirter passage downstream from the plurality of piston squirters.

6. The system of claim 5, wherein the return passage includes a check valve.

7. An engine method comprising:

lubricating an engine component with more-filtered oil;

directing less-filtered oil to an oil supply during engine warm-up to bypass an oil cooler; and cooling a plurality of pistons with the less-filtered oil after engine warm-up, the less-filtered oil passing through the cooler and provided to a plurality of piston squirters to spray the plurality of pistons.

8. The method of claim 7, wherein the less-filtered oil is unfiltered from a pump to the plurality of piston squirters and wherein the more-filtered oil is filtered via a filter between the pump and the engine component, and wherein a controller actuates a valve to enable unfiltered oil to flow through the cooler or to a return passage to bypass the cooler.

9. The method of claim 8, wherein the valve is closed during engine warm up to enable unfiltered oil to return to the oil supply, and wherein the valve is opened after engine warm up to enable unfiltered oil to pass through the cooler to the plurality of piston squirters positioned downstream from the cooler.

10. The method of claim 9, further comprising enabling less-filtered oil flow through a return passage downstream from a final piston squirter, the final piston squirter one of the plurality of piston squirters, the return passage configured to reduce an oil pressure fluctuation within an oil squirter passage.

11. A method for engine oil delivery comprising:

pumping oil through a filtering circuit to lubricate an engine and returning unfiltered oil to an oil supply during engine warm up; and pumping oil through the filtering circuit to lubricate the engine and bypassing oil around the filtering circuit and through a cooling circuit to cool a plurality of pistons when an engine temperature exceeds a predetermined threshold.

12. The method of claim 11, wherein the predetermined threshold is a catalyst light-off temperature.

13. The method of claim 11, wherein the engine temperature is sensed by a sensor that provides the engine temperature to a controller.

14. The method of claim 11, wherein the filtering circuit and the cooling circuit are fluidically coupled via a common feeder passage.

15. The method of claim 14, wherein the filtering circuit includes a filter and the cooling circuit includes a cooler.

16. The method of claim 15, wherein the filtering circuit and the cooling circuit are downstream from a pump, an inlet of the cooling circuit fluidically coupled to the feeder passage at a position between the filter and the pump.

17. The method of claim 16, wherein oil pumped through the cooling circuit is less-filtered than the oil pumped through the filtering circuit.

* * * * *